US008602109B2

(12) United States Patent
Gustafson

(10) Patent No.: US 8,602,109 B2
(45) Date of Patent: Dec. 10, 2013

(54) SUBSEA FORCE GENERATING DEVICE AND METHOD

(75) Inventor: Ryan Gustafson, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 1023 days.

(21) Appl. No.: 12/338,652

(22) Filed: Dec. 18, 2008

(65) Prior Publication Data

US 2010/0155071 A1 Jun. 24, 2010

(51) Int. Cl.
*E21B 7/12* (2006.01)

(52) U.S. Cl.
USPC ..... 166/373; 166/361; 166/363

(58) Field of Classification Search
USPC ..... 166/335, 340, 355, 357, 364
See application file for complete search history.

(56) References Cited

U.S. PATENT DOCUMENTS

| | | | | |
|---|---|---|---|---|
| 2,721,446 | A * | 10/1955 | Bumb | 60/415 |
| 2,747,370 | A * | 5/1956 | Traut | 138/31 |
| 3,163,985 | A | 1/1965 | Bouyoucos | |
| 3,436,914 | A | 4/1969 | Rosfelder | |
| 3,750,404 | A * | 8/1973 | Murman et al. | 60/413 |
| 3,921,500 | A | 11/1975 | Silcox | |
| 3,987,708 | A * | 10/1976 | Uhrich | 92/134 |
| 4,095,421 | A | 6/1978 | Silcox | |
| 4,294,284 | A * | 10/1981 | Herd | 137/613 |
| 4,777,800 | A * | 10/1988 | Hay, II | 60/593 |
| 5,357,999 | A | 10/1994 | Loth | |
| 6,192,680 | B1 * | 2/2001 | Brugman et al. | 60/398 |
| 6,202,753 | B1 | 3/2001 | Baugh | |
| 6,266,959 | B1 * | 7/2001 | Markwart | 60/414 |
| 6,418,970 | B1 * | 7/2002 | Deul | 138/31 |
| 7,090,019 | B2 * | 8/2006 | Barrow et al. | 166/361 |
| 7,219,739 | B2 * | 5/2007 | Robichaux | 166/355 |
| 7,231,981 | B2 * | 6/2007 | Moe et al. | 166/355 |
| 7,314,087 | B2 * | 1/2008 | Robichaux | 166/355 |
| 7,318,480 | B2 | 1/2008 | Hosie et al. | |
| 7,424,917 | B2 | 9/2008 | Martin | |

(Continued)

FOREIGN PATENT DOCUMENTS

| | | | |
|---|---|---|---|
| EP | 2 199 535 | A1 | 6/2010 |
| WO | 2006/048669 | A1 | 5/2006 |
| WO | 2006/068873 | A1 | 6/2006 |
| WO | 2009/035945 | A1 | 3/2009 |

OTHER PUBLICATIONS

European Search Report issued on Apr. 12, 2010 in corresponding European application No. EP09178142.

(Continued)

*Primary Examiner* — Matthew Buck
*Assistant Examiner* — Aaron Lembo
(74) *Attorney, Agent, or Firm* — Bracewell & Giuliani LLP

(57) ABSTRACT

Method and water submerged device for generating a force under water. The device includes a low pressure recipient configured to contain a volume of a first fluid at a low pressure volume, an inlet connected to the low pressure recipient and configured to exchange a second fluid with an external enclosure, and a valve connected to the external enclosure and the inlet and configured to separate a pressure source in the external enclosure from the low pressure recipient. When the valve is open, such that there is a flow communication between the external enclosure and the low pressure recipient, a pressure imbalance occurs in the external enclosure which generates the force and the second fluid from the external enclosure enters the low pressure recipient and compresses the first fluid.

20 Claims, 11 Drawing Sheets

(56) References Cited

U.S. PATENT DOCUMENTS

| | | | | |
|---|---|---|---|---|
| 7,520,129 | B2 * | 4/2009 | Springett | 60/398 |
| 7,628,207 | B2 * | 12/2009 | Leonardi et al. | 166/364 |
| 7,735,563 | B2 * | 6/2010 | Judge et al. | 166/357 |
| 7,823,646 | B2 * | 11/2010 | Ellis et al. | 166/355 |
| 7,891,429 | B2 * | 2/2011 | Boyce et al. | 166/340 |
| 2003/0037544 | A1 | 2/2003 | Armstrong | |
| 2008/0104951 | A1 * | 5/2008 | Springett | 60/413 |
| 2008/0185046 | A1 * | 8/2008 | Springett et al. | 137/14 |

OTHER PUBLICATIONS

Substantive Examination Adverse Report issued in related Malaysian Patent Application No. PI 20095242; dated Jun. 28, 2013; 4 pages.

* cited by examiner

SUBSEA FORCE GENERATING DEVICE AND METHOD

BACKGROUND

1. Technical Field

Embodiments of the subject matter disclosed herein generally relate to methods and systems and, more particularly, to mechanisms and techniques for generating a subsea force.

2. Discussion of the Background

During the past years, with the increase in price of fossil fuels, the interest in developing new production fields has dramatically increased. However, the availability of land-based production fields is limited. Thus, the industry has now extended drilling to offshore locations, which appear to hold a vast amount of fossil fuel.

The existing technologies for extracting the fossil fuel from offshore fields use a system 10 as shown in FIG. 1. More specifically, the system 10 includes a vessel 12 having a reel 14 that supplies power/communication cords 16 to a controller 18. A Mux Reel may be used to transmit power and communication. Some systems have hose reels to transmit fluid under pressure or hard pipe (rigid conduit) to transmit the fluid under pressure or both. Other systems may have a hose with communication or lines (pilot) to supply and operate functions subsea. However, a common feature of these systems is their limited operation depth. The controller 18, which will be discussed later, is disposed undersea, close to or on the seabed 20. In this respect, it is noted that the elements shown in FIG. 1 are not drawn to scale and no dimensions should be inferred from FIG. 1.

FIG. 1 also shows a wellhead 22 of the subsea well and a production tubing 24 that enters the subsea well. At the end of the production tubing 24 there is a drill (not shown). Various mechanisms, also not shown, are employed to rotate the production tubing 24, and implicitly the drill, to extend the subsea well.

However, during normal drilling operation, unexpected events may occur that could damage the well and/or the equipment used for drilling. One such event is the uncontrolled flow of gas, oil or other well fluids from an underground formation into the well. Such event is sometimes referred to a "kick" or a "blowout" and may occur when formation pressure exceeds the pressure applied to it by the column of drilling fluid. This event is unforeseeable and if no measures are taken to prevent it, the well and/or the associated equipment may be damaged.

Another event that may damage the well and/or the associated equipment is a hurricane or an earthquake. Both of these natural phenomena may damage the integrity of the well and the associated equipment. For example, due to the high winds produced by a hurricane at the surface of the sea, the vessel or the rig that powers the undersea equipment starts to drift resulting in breaking the power/communication cords or other elements that connect the well to the vessel or rig. Other events that may damage the integrity of the well and/or associated equipment are possible as would be appreciated by those skilled in the art.

Thus, a blowout preventer (BOP) might be installed on top of the well to seal it in case that one of the above events is threatening the integrity of the well. The BOP is conventionally implemented as a valve to prevent the release of pressure either in the annular space between the casing and the drill pipe or in the open hole (i.e., hole with no drill pipe) during drilling or completion operations. FIG. 1 shows BOPs 26 or 28 that are controlled by the controller 18, commonly known as a POD. The blowout preventer controller 18 controls an accumulator 30 to close or open BOPs 26 and 28. More specifically, the controller 18 controls a system of valves for opening and closing the BOPs. Hydraulic fluid, which is used to open and close the valves, is commonly pressurized by equipment on the surface. The pressurized fluid is stored in accumulators on the surface and subsea to operate the BOPs. The fluid stored subsea in accumulators may also be used to autoshear and/or for deadman functions when the control of the well is lost. The accumulator 30 may include containers (canisters) that store the hydraulic fluid under pressure and provide the necessary pressure to open and close the BOPs. The pressure from the accumulator 30 is carried by pipe or hose 32 to BOPs 26 and 28.

As understood by those of ordinary skill, in deep-sea drilling, in order to overcome the high hydrostatic pressures generated by the seawater at the depth of operation of the BOPs, the accumulator 30 has to be initially charged to a pressure above the ambient subsea pressure. Typical accumulators are charged with nitrogen but as precharge pressures increase, the efficiency of nitrogen decreases which adds additional cost and weight because more accumulators are required subsea to perform the same operation on the surface. For example, a 60-liter (L) accumulator on the surface may have a useable volume of 24 L on the surface but at 3000 m of water depth the usable volume is less than 4 L. To provide that additional pressure deep undersea is expensive, the equipment for providing the high pressure is bulky, as the size of the canisters that are part of the accumulator 30 is large, and the range of operation of the BOPs is limited by the initial pressure difference between the charge pressure and the hydrostatic pressure at the depth of operation.

In this regard, FIG. 2 shows the accumulator 30 connected via valve 34 to a cylinder 36. The cylinder 36 may include a piston (not shown) that moves when a first pressure on one side of the piston is higher than a second pressure on the other side of the piston. The first pressure may be the hydrostatic pressure plus the pressure released by the accumulator 30 while the second pressure may be the hydrostatic pressure. Therefore, the use of pressured canisters to store high-pressure fluids to operate a BOP make the operation of the offshore rig expensive and require the manipulation of large parts.

Still with regard to FIG. 2, the valve 34 may be provided between the accumulator 30 and the cylinder 36 in order to control the timing for applying the supplemental pressure from the accumulator 30. The supplemental pressure may be generated by the accumulator 30, according to an exemplary embodiment, by providing, for example, 16 300-L bottles, each carrying nitrogen under pressure. FIG. 3 shows such an example of a bottle 50. FIG. 3 shows that a bottle 50 has a first chamber 52 that includes nitrogen under pressure and a second chamber 54, separated by a bladder or piston 56 from the first chamber 52. The second chamber 54 is connected to the pipe 32 and includes hydraulic fluid. When the controller 18 instructs the accumulator 30 to release its pressure, each bottle 50 uses the nitrogen pressure to move the bladder 56 towards the pipe 32 such that the supplemental pressure is provided via pipe 32 to the cylinder 36.

Accordingly, it would be desirable to provide systems and methods that avoid the afore-described problems and drawbacks, i.e., low efficiency, safety issues related to the surface high precharge pressures, large size and weight of the accumulator, etc.

SUMMARY

According to one exemplary embodiment, there is a water submerged device for generating a force under water. The device includes a low pressure recipient configured to contain a volume of a first fluid at a low pressure volume; an inlet connected to the low pressure recipient and configured to exchange a second fluid with an external enclosure; and a valve connected to the external enclosure and the inlet and configured to separate a pressure source in the external enclosure from the low pressure recipient. When the valve is open, such that there is a flow communication between the external enclosure and the low pressure recipient, a pressure imbalance occurs in the external enclosure which generates the force and the second fluid from the external enclosure enters the low pressure recipient and compresses the first fluid.

According to another exemplary embodiment, there is a method for generating a force by moving a piston inside an external enclosure of a water submerged device, the piston dividing the external enclosure into a closing chamber and an opening chamber and the opening chamber communicating with a low pressure recipient via a pipe having a valve, the valve separating a pressure source in the opening chamber from the low pressure recipient, and the low pressure recipient containing a volume of a first fluid. The method includes applying a first pressure to the closing and opening chambers, wherein the first pressure is generated by a weight of the water at a certain depth of the device; applying a second pressure to the first fluid of the low pressure recipient, the second pressure being lower than the first pressure; opening the valve between the opening chamber and the low pressure recipient such that a second fluid from the opening chamber moves into the low pressure recipient and compresses the first fluid; and generating the force by producing a pressure imbalance on the piston.

According to yet another exemplary embodiment, there is a blowout preventer activation device. The device includes a low pressure recipient configured to contain a volume of a first fluid at a low pressure volume; an inlet connected to the low pressure recipient and configured to exchange a second fluid with an external enclosure; a valve connected to the external enclosure and the inlet and configured to separate a pressure source in the external enclosure from the low pressure recipient; and at least one of a ram preventer including connected to a piston of the external enclosure and configured to receive the force and close rams to shear a pipe between the rams, and an annular blowout preventer connected to a piston of the external enclosure and configured to receive the force to seal a wellbore. When the valve is open, such that there is a flow communication between the external enclosure and the low pressure recipient, a pressure imbalance occurs in the external enclosure which generates the force and the second fluid from the external enclosure enters the low pressure recipient and compresses the first fluid.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of BOP systems. However, the embodiments to be discussed next are not limited to these systems, but may be applied to other systems that require the supply of force when the ambient pressure is high such as in a subsea environment.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 2:
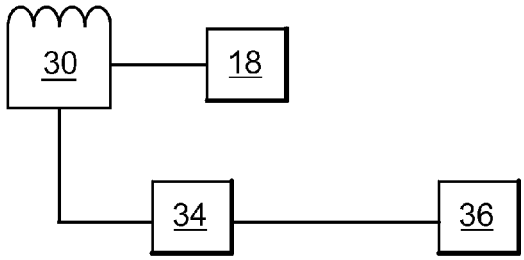
FIG. 2 Prior Art
FIG. 2 is a schematic diagram of a water submerged device for generating a force based on an accumulator.
Figure 3:
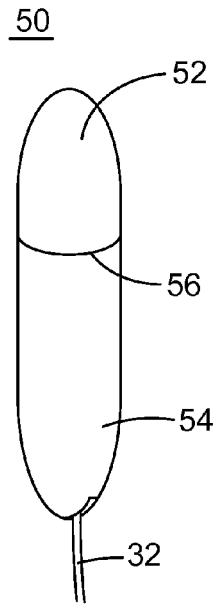
FIG. 3 Prior Art
FIG. 3 is a schematic diagram of a canister for producing supplemental pressure.

As discussed above with regard to FIG. 2, the accumulator 30 is bulky because of the low efficiency of nitrogen at high pressures. As the offshore fields are located deeper and deeper (in the sense that the distance from the sea surface to the seabed is becoming larger and larger), the nitrogen based accumulators become less efficient given the fact that the difference between the initial charge pressure to the local hydrostatic pressure decreases for a given initial charge of chamber 52, thus, requiring the size of the accumulators to increase (it is necessary to use 16 320-L bottles), and increasing the price to deploy and maintain the accumulators.

Figure 4:
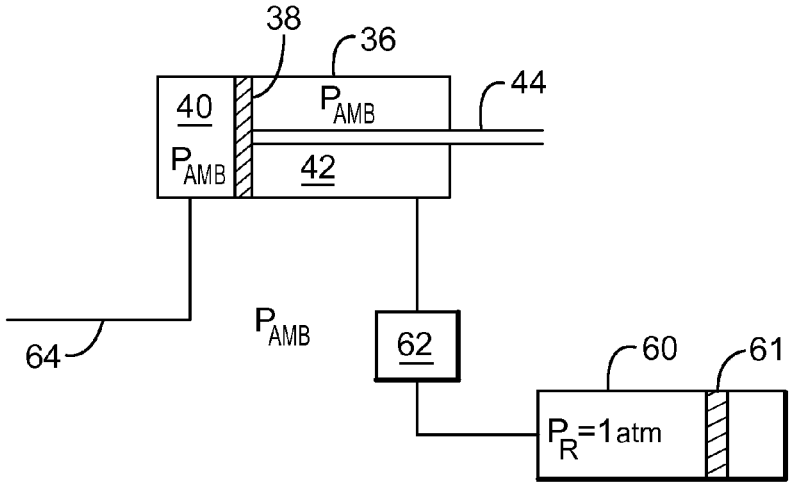
FIG. 4 is a schematic diagram of a water submerged device for generating a force without an accumulator according to an exemplary embodiment.

According to an exemplary embodiment, a novel arrangement, as shown in FIG. 4, may be used to generate the force F. FIG. 4 shows an enclosure 36 that includes a piston 38 capable of moving inside the enclosure 36. The piston 38 divides the enclosure 36 into a chamber 40, defined by the cylinder 36 and the piston 38. Chamber 40 is called the closing chamber. Enclosure 36 also includes an opening chamber 42 as shown in FIG. 4.

The pressure in both chambers 40 and 42 may be the same, i.e., the sea pressure (ambient pressure). The ambient pressure in both chambers 40 and 42 may be achieved by allowing the sea water to freely enter these chambers. Thus, as there is no pressure difference on either side of the piston 38, the piston 38 is at rest.

When a force is necessary to be supplied for activating a piece of equipment, the rod 44 associated with the piston 38 has to be moved. This may be achieved by generating a pressure imbalance on two sides of the piston 38.

Although the exemplary embodiment, which is shown in FIG. 4, describes how to generate the undersea force without the use of the accumulators, however, as will be discussed later, according to another exemplary embodiment, the accumulators still may be used to supply the supplemental pressure. FIG. 4 shows the enclosure 36 (which may be a cylinder) that includes the piston 38 and a rod 44 connected to piston 38. The opening chamber 42 may be connected to a low pressure storage recipient 60. A valve 62 may be inserted between the opening chamber 42 and the low pressure recipient 60 to control the pressures between the opening chamber and the recipient 60. The low pressure recipient 60 may include a piston 61 that is placed in the low pressure recipient 60 to slide inside the low pressure recipient 60 to divide a compressible fluid, inside the low pressure recipient 60, from the enclosure 36. The low pressure recipient 60 may include a bladder or a sealing element instead of the piston 61. The compressible fluid (first fluid) may be, for example, air.

The low pressure storage recipient 60 may have any shape and may be made of steel, or any material that is capable of withstanding seawater pressures. However, the initial pressure inside the low pressure recipient is about 1 atm or lower to improve the efficiency, when the recipient is at the sea level. After the recipient is lowered to the sea bed, the pressure inside the recipient may become higher as the sea level exerts a high pressure on the walls of the recipient, thus compressing the gas inside. Other fluids than air may be used to fill the low pressure recipient. However, the pressure inside the recipient 60 is smaller than the ambient pressure $P_{amb}$, which is approximately 350 atm at 4000 m depth.

As shown in FIG. 4, when there is no need to supply the force, the pressure in both the closing and opening chambers is $P_{amb}$ while the pressure inside the recipient 60 is approximately $P_r$=1 atm. When a force applied to the rod 44 is required for actuation of a piece of equipment in the rig, the valve 62 opens such that the opening chamber 42 may communicate with the low pressure storage recipient 60. The following pressure changes take place in the closing chamber 40, the opening chamber 42 and the recipient 60. The closing chamber 40 remains at the ambient pressure as more seawater enters via pipe 64 to the closing chamber 40 as the piston 38 starts moving from left to right in FIG. 4. The pressure in the opening chamber 42 decreases as the low pressure $P_r$ becomes available via the valve 42, i.e., seawater (second fluid, which may be incompressible) from the opening chamber 42 moves to the recipient 60 to equalize the pressures between the opening chamber 42 and the recipient 60. Thus, a pressure imbalance is achieved between the closing chamber 40 and the opening chamber 42 and this pressure imbalance triggers the movement of the piston 38.

Figure 5:
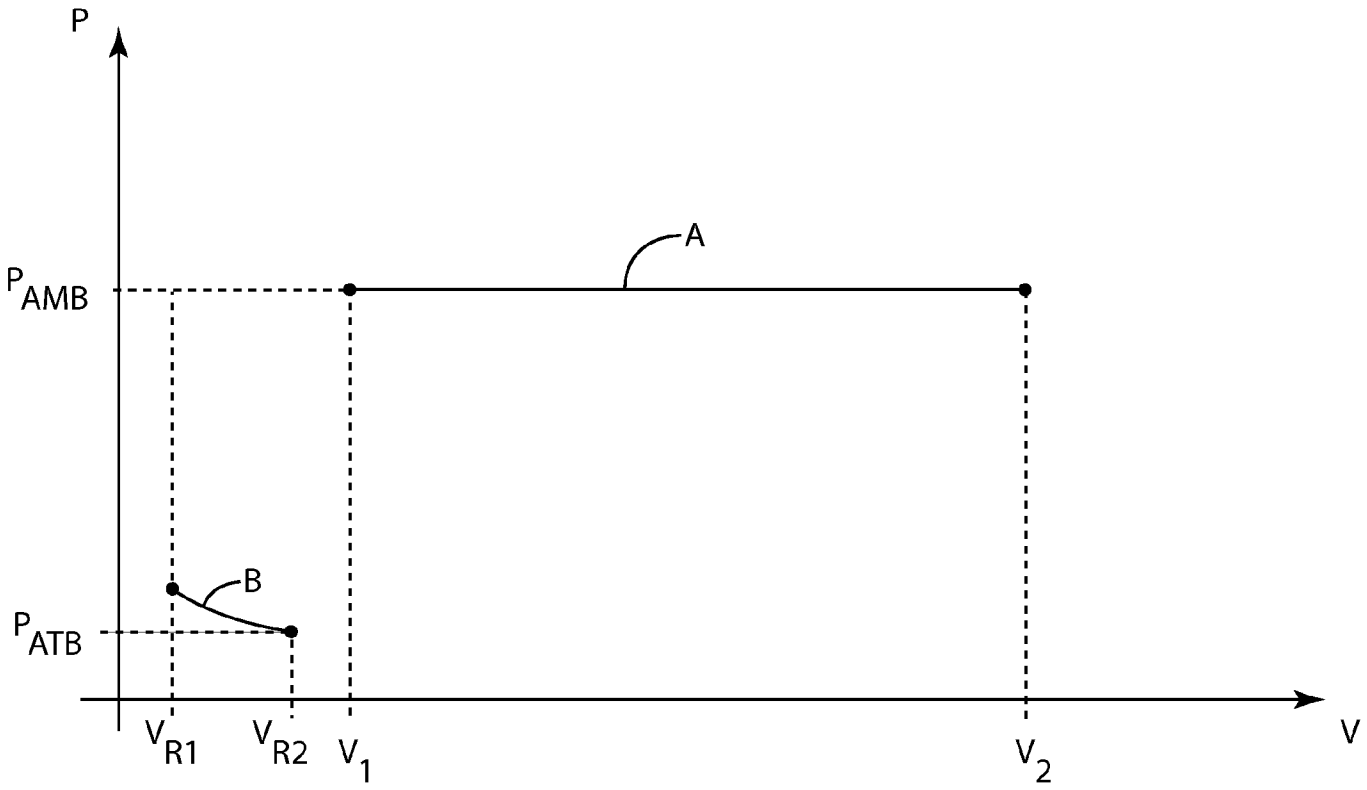
FIG. 5 is a graph illustrating a dependence of a pressure relative to a volume of a fluid inside the submerged device according to an exemplary embodiment.

FIG. 5 shows a graph of the pressure versus volume for the closing chamber 40 and the recipient 60. The pressure of the closing chamber 40 remains substantially constant (see curve A) while the volume of the closing chamber 40 expands from a small initial volume, V1, to a larger final volume, V2, while the pressure in the recipient 60 slightly increasing from approximately 1 atm due to the liquid received from the opening chamber 42, as shown by curve B.

Thus, according to an exemplary embodiment, a large force F is achieved without using any canister charged with nitrogen at high pressure. Therefore, the system shown in FIG. 4 advantageously provides a reduced cost solution to generating a force as the low pressure recipient 60 is filed with, for example, air at sea level surface. In addition, the device for generating the force may have a small size as the size of the low pressure recipient is smaller compared to the existing accumulators. In one exemplary embodiment, the low pressure recipient may be a stainless steel container having a 250 l volume. Another advantage of the device shown in FIG. 4 is the possibility to easily retrofit the existing deep sea rigs with such a device.

Figure 6:
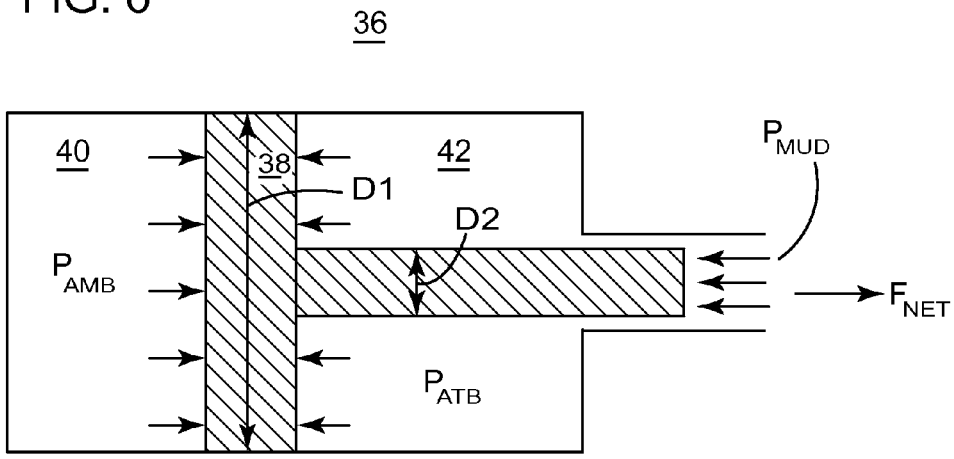
FIG. 6 is a schematic diagram of a water submerged device illustrating various pressures acting on the device.

According to an exemplary embodiment shown in FIG. 6, a numerical example is provided for appreciating the effectiveness of the low pressure recipient 60. The example shown in FIG. 6 is not intended to limit the exemplary embodiments but only to offer to the reader a better understanding of the force generated by the low pressure recipient 60. FIG. 6 shows the enclosure 36 including the piston 38 with the various pressures acting on it. More specifically, the pressure in the closing chamber 40 is $P_{AMB}$, the pressure in the opening chamber is $P_{ATM}$, when the opening chamber 42 communicates with the low pressure recipient 60, and the pressure acting on rod 44 is $P_{MUD}$, which is the column pressure or wellbore pressure depending on the application. The net force $F_{NET}$, which is calculated in this example, is constant along the entire stroke of the piston. This is different from conventional devices in which the force decreases as the piston in the accumulator moves due to the lost pressure as the nitrogen gas expands. Preferably, a constant pressure would ensure enough pressure/force to cut the drill pipe when needed.

Assuming that $P_{AMB}$ is 4,500 psi, $P_{ATM}$ is 14.5 psi, $P_{MUD}$ is 15,000 psi, D1 is 22 in, and D2 is 5,825 in, the net force $F_{NET}$ is given by:

$$F_{NET}=P_{AMB}(\pi/4)(D1)^2-P_{ATM}(\pi/4)[(D1)^2-(D2)^2]-P_{MUD}(\pi/4)(D2)_2=1{,}298{,}850\text{ lbf.}$$

Assuming that $P_{ATM}$ is 4,500 psi, the net opening force $F_{NET}$ is −284,639 lbf. According to an exemplary embodiment, the ambient pressure (high pressure) may be between 200 and 400 atm and the $P_{ATM}$ (low pressure) may be between 0.5 and 10 atm.

Figure 7:
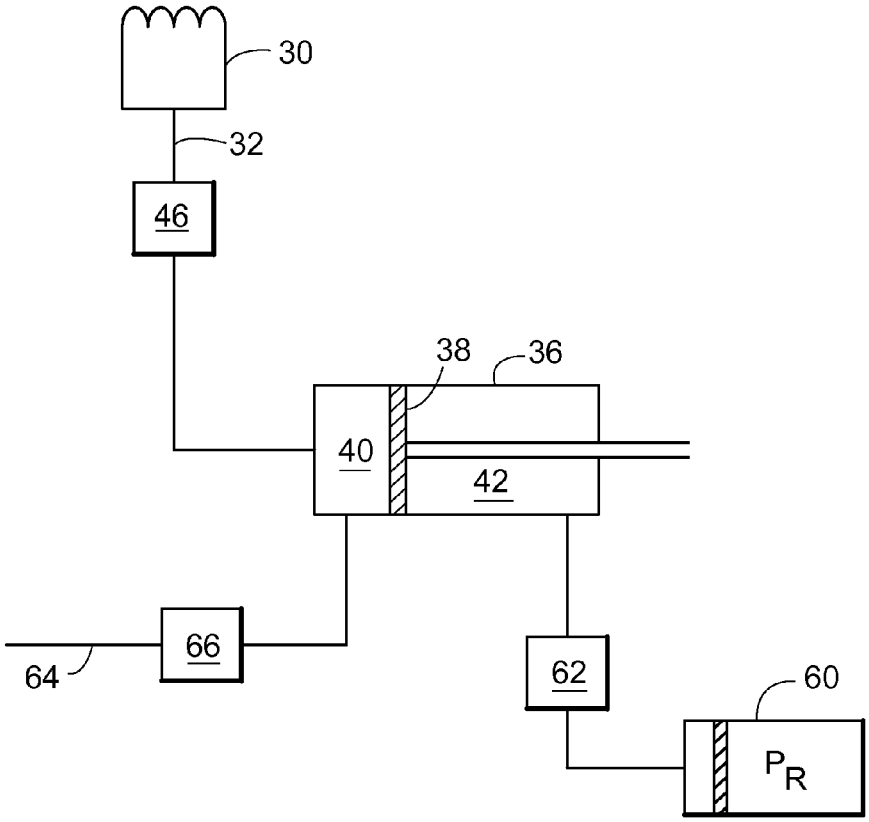
FIG. 7 is a schematic diagram of a water submerged device for generating a force based on an accumulator according to an exemplary embodiment.

According to another exemplary embodiment, the low pressure recipient 60 may be used in conjunction with nitrogen based accumulators as shown in FIG. 7. The closing chamber 40 of the enclosure 36 is connected not only to the seawater via pipe 64 but also to the accumulator 30 that is capable of supplying supplemental pressure. When appropriate conditions are reached, a valve 66 may close the sea water supply to the closing chamber 40 and valve 46 may open to allow the supplemental pressure from the accumulator 30 to reach the closing chamber 40. According to an exemplary embodiment, the hydraulic liquid from accumulator 30 mixes with the seawater from the closing chamber 40. According to another exemplary embodiment, another piston (not shown) separates the hydraulic liquid of accumulator 30 from the seawater inside the closing chamber 40. Optionally, the valve 66 opens when the pressure in the accumulator 30 becomes less than a preset threshold. The variation of pressure as a function of volume for the accumulator 30 is illustrated by shape C in FIG. 8. Thus, the supplemental pressure (curve C) decreases as the piston 38 moves, producing a diminishing supplemental force on the rod 44. The profile of curve C is given by an appropriate equation of state for the particular gas used in the accumulator 30, depending on whether the temperature or heat transfer is considered to be constant or negligible, i.e., whether the change of state for the gas is isothermal or adiabatic, respectively.

Figure 8:
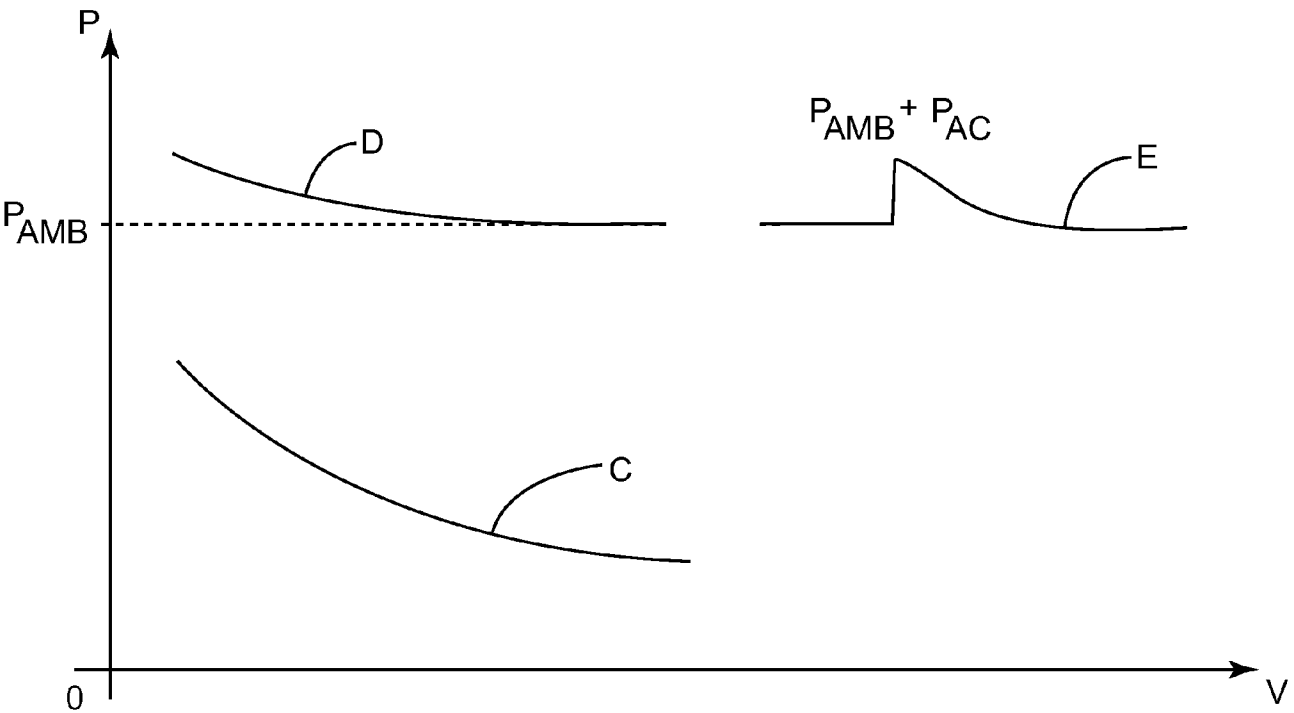
FIG. 8 is a graph illustrating various pressure dependences with volume according to exemplary embodiments.

However, as one of ordinary skill in the art knows, the product of pressure and volume of an ideal gas is proportional to the gas temperature, as illustrated by curve C in FIG. 8. Thus, in a conventional accumulator, when the pressure of the canisters is released to a specific device, the pressure decreases as the volume increases. On the contrary, the pressure in the closing chamber 40 does not change inversely proportional with the increase of volume of this chamber as shown by curve A in FIG. 5, i.e., the pressure stays substantially constant when the volume of the closing chamber 40 increases.

However, when the supplemental pressure from accumulator 30 is combined with the low pressure of the low pressure recipient 60, the pressure exerted on the piston 38 from the closing chamber 40 has the profile shown by curve D in FIG. 8, i.e., a high pressure that slightly decreases with the movement of the piston 38. According to an exemplary embodiment, the pressure from accumulator 30, $P_{AC}$, may be released after the low pressure storage recipient 60 becomes activated, thus producing the pressure profile shown by curve E in FIG. 8. It is noted that according to this profile, the pressure in the closing chamber is $P_{amb}$ after valve 62 has been opened and increases to $P_{amb}+P_{AC}$ when the supplemental pressure from the accumulator 30 is made available.

Figure 1:
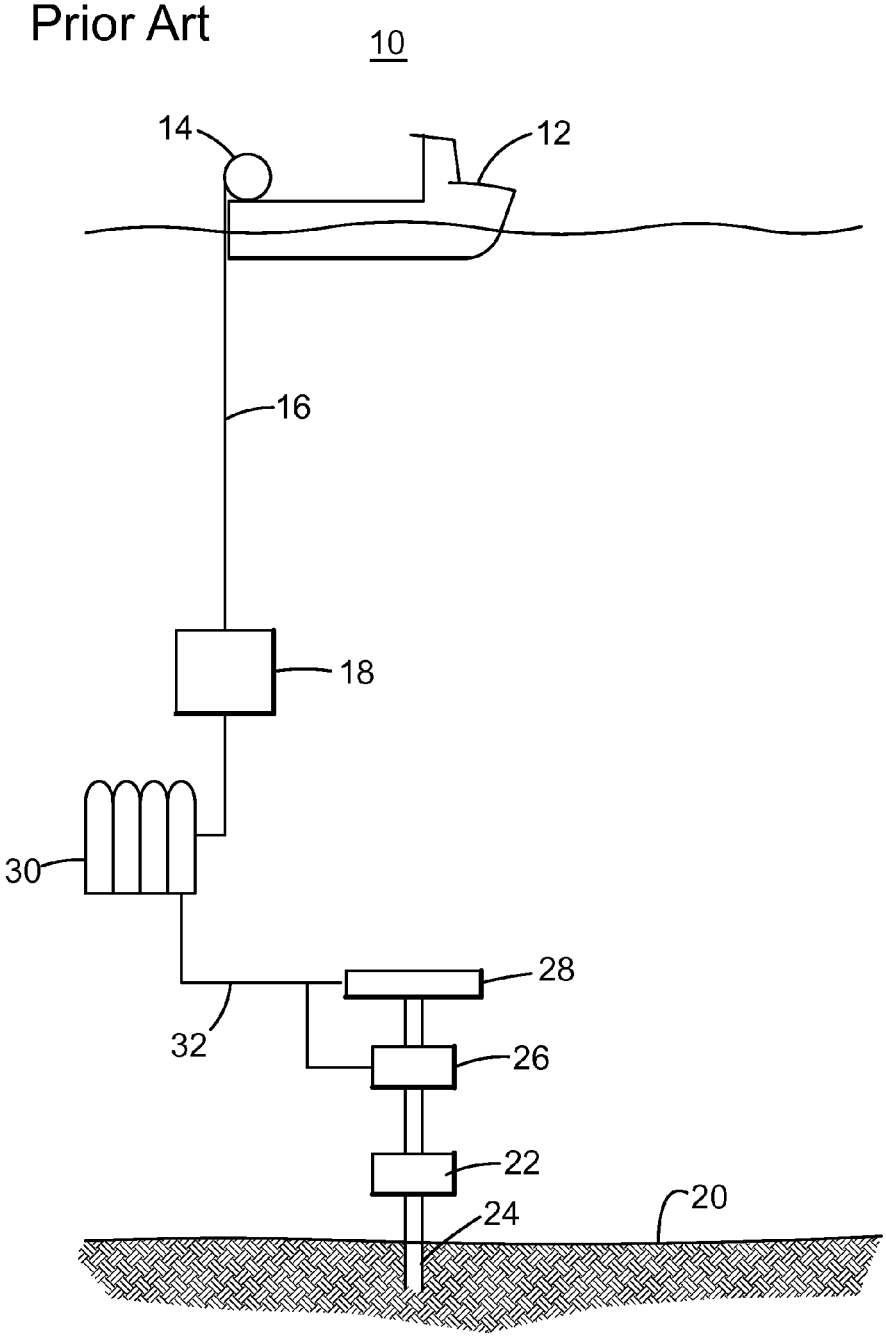
FIG. 1 Prior Art
FIG. 1 is a schematic diagram of a conventional offshore rig.

The spike in pressure shown in FIG. 8 in profile E may be advantageous as discussed next. Returning to FIG. 1, the BOP is shown to include two elements 26 and 28. Element 28 may be an annular blowout preventer while element 26 may be a ram blowout preventer. The annular blowout preventer 28 is a valve, that may be installed above the ram preventer 26 to seal the annular space between the pipe and the wellbore or, if no pipe is present, the wellbore itself. The annular blowout preventer does not cut (shear) the lines or pipes present in the wellbore but only seals the well. However, if the annular blowout preventer fails to seal the wellbore or is not enough, the ram preventer may be activated.

The ram preventer may use rams to seal off pressure on a hole that is with or without pipe. If the hole includes a pipe, the ram preventer needs enough force to shear (cut) the pipe and any cords that might be next or inside the pipe such that the well is completely closed, to prevent a pressure release to the atmosphere.

Thus, the force providing devices discussed in the exemplary embodiments may be used to provide the necessary force to the annular blowout preventer, the ram preventer, both of them, etc. Other applications of the force providing exemplary embodiments may be envisioned by one skilled in the art, such for example, applying the force to any subsea valve on the BOP stack or production trees.

Figure 9:
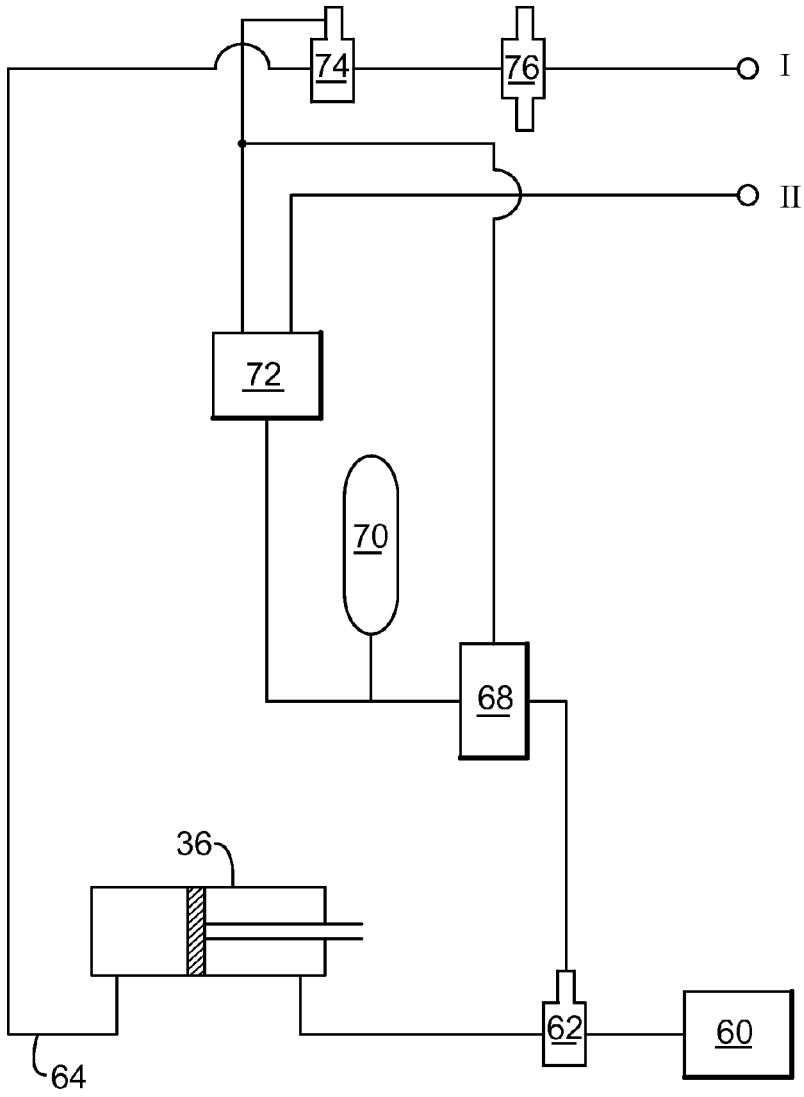
FIG. 9 is a schematic diagram of a water submerged device for generating a force according to an exemplary embodiment.
Figure 10:
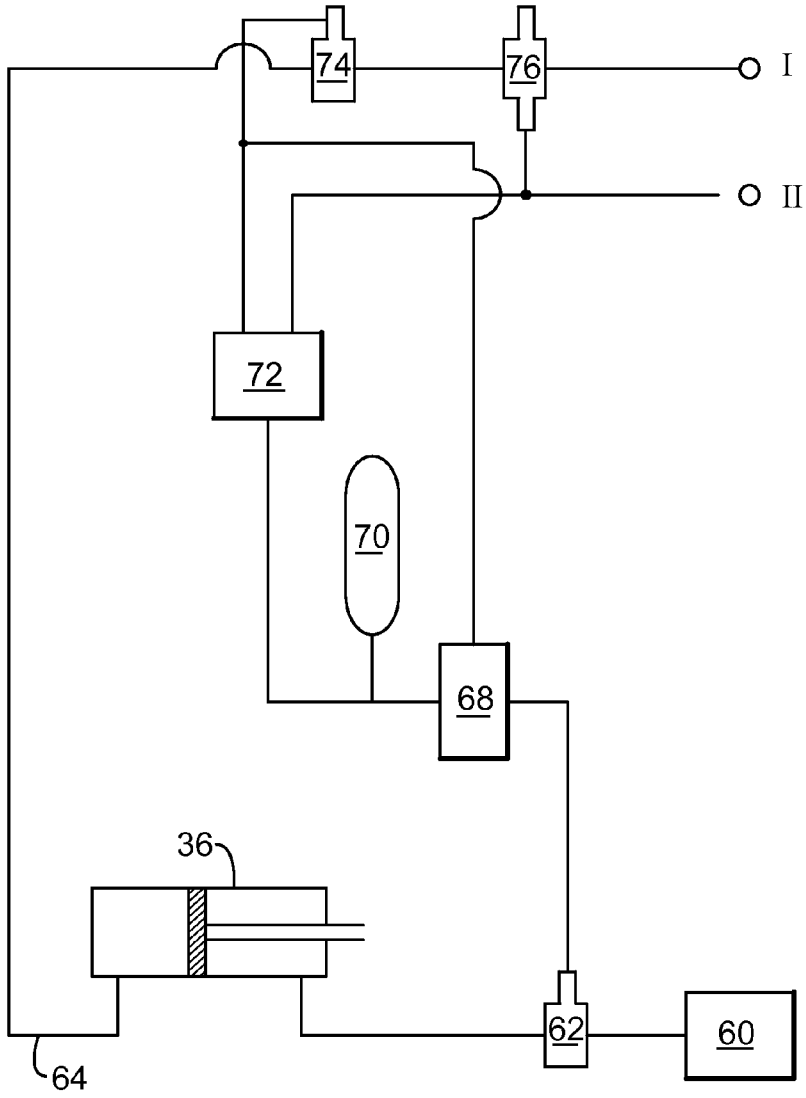
FIG. 10 is a schematic diagram of a water submerged device for generating a force according to another exemplary embodiment.

Various valves and pilots may be added between each chamber and the low pressure recipient 60 and/or accumulator 30 as will be appreciated by those skilled in the art. Two exemplary diagrams showing the implementation of the low pressure recipient 60 are shown in FIGS. 9 and 10. However, these examples are intended to facilitate the understanding of the reader and not to limit the exemplary embodiments. FIG. 9 shows the cylinder 36 connected to the pipe 64 and the low pressure recipient 60 via the valve 62. Valve 62 is connected to a plunger valve 68 that is connected to a pilot accumulator 70. The pilot accumulator 70 may be, for example, a 2.5-L recipient. The pilot accumulator 70 may be connected, via a coupler 72 to an autoshear valve pilot 74 and an autoshear arm pilot 76. A port I is provided to connect line 64 to seawater and a port II is connected to coupler 72 and to an auto-shear disarm pilot. In another exemplary embodiment shown in FIG. 10, the plunger valve 68 is substituted with a valve that is connected to the valve pilot 74.

Figure 11A:
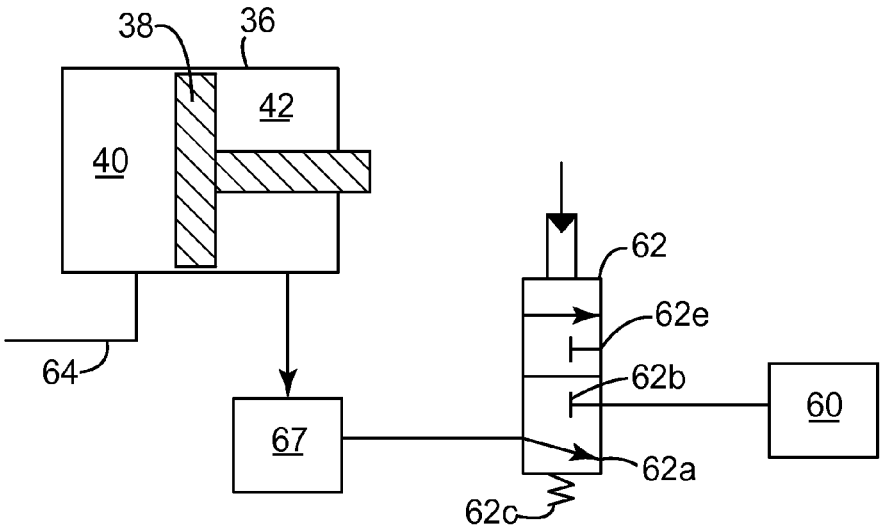
FIGS. 11A and B are schematic diagrams of a valve connecting the BOP to the water submerged device for generating the force.
Figure 11B:
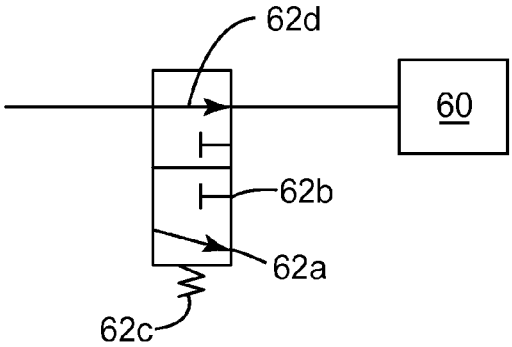

Valve 62 is discussed in more details with regard to FIGS. 11A and B. FIG. 11A shows the enclosure 36 connected to the low pressure recipient 60 via a a shuttle valve 67 and the valve 62. The shuttle valve 67 may be a spring bias type to prevent seawater ingress and to maintain the correct position to vent. Valve 62 (which is produced by Hydril, Houston, Tex., US) may be a 3-way 2-position valve that is spring loaded to maintain its position. As shown in FIG. 11A, the opening chamber 42 is connected to a vent port 62*a* in the valve 62 that is always open to seawater. However, the port 62*b* of valve 62, which is connected to the low pressure recipient 60, is blocked to maintain the low pressure in the low pressure recipient 60. When functioned by an external pilot (not shown), an internal spool of the valve moves compressing spring 62*c*, blocking the vent port 62*a*, and opening the opening chamber 42 to the low pressure recipient 60. After valve 62 is piloted by the external pilot it looks as shown in FIG. 11B, in which a free communication is allowed between the opening chamber 42 and the low pressure recipient 60. Element 62*e* shown in FIG. 11A blocks the vent port 62*a* in FIG. 10B.

Figure 12:
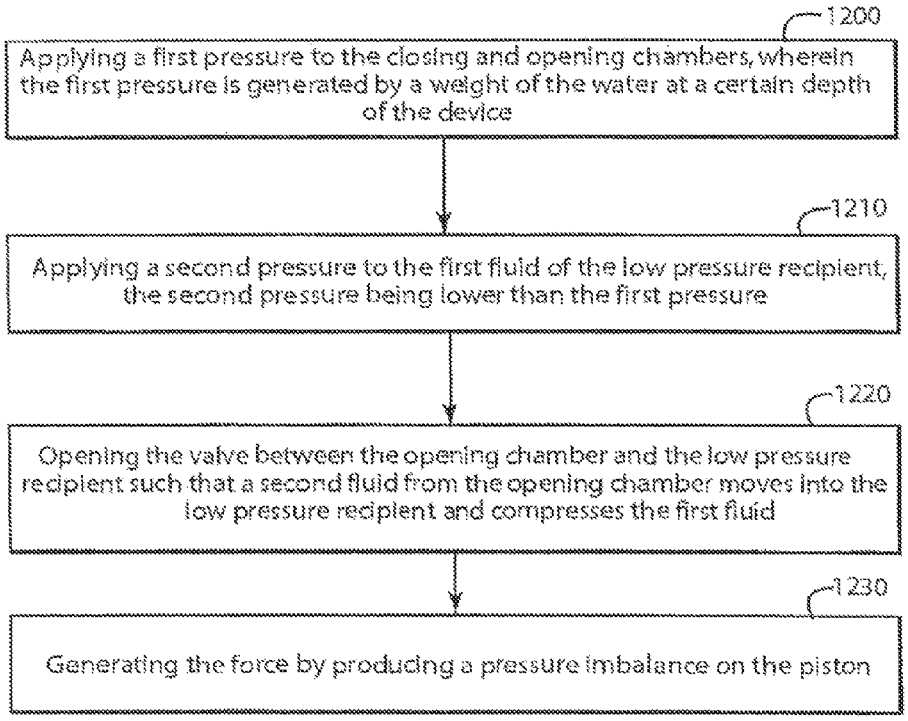
FIG. 12 is a flow chart illustrating steps performed by a method for generating a force according to an exemplary embodiment.

According to an exemplary embodiment, illustrated in FIG. 12, there is a method for generating a force by moving a piston inside an external enclosure of a water submerged device, the piston dividing the external enclosure into a closing chamber and an opening chamber and the opening chamber communicating with a low pressure recipient via a pipe having a valve, the valve separating a pressure source in the opening chamber from the low pressure recipient, and the low pressure recipient containing a volume of a first fluid. The method includes a step 1200 of applying a first pressure to the closing and opening chambers, wherein the first pressure is generated by a weight of the water at a certain depth of the device, a step 1210 of applying a second pressure to the first fluid of the low pressure recipient, the second pressure being lower than the first pressure, a step 1220 of opening the valve between the opening chamber and the low pressure recipient such that a second fluid from the opening chamber moves into the low pressure recipient and compresses the first fluid, and a step 1230 of generating the force by producing a pressure imbalance on the piston.

According to an exemplary embodiment, one or more pressure sensors may be inserted into the low pressure recipient 60 to monitor its pressure. When the pressure sensor determines that the pressure inside the recipient 60 is far from 1 atm, the operator of the rig is informed of this fact such that the operator may rely on other force generator for closing the ram preventer in case of an emergency or for replacing the recipient 60. Alternatively, the recipient 60 may be provided with a hydraulic equipment (not shown) which starts pumping the water out of the recipient when the sensor senses that the pressure inside the recipient is above a certain threshold. In another exemplary embodiment, the hydraulic equipment may pump out the water from the recipient 60 after the valve 62 has been opened and the ram preventer has closed. It is noted that after the recipient 60 is filled with water it cannot be used to generate the force unless the low pressure is reestablished inside the recipient 60.

According to another exemplary embodiment, more than one recipient 60 may be used either simultaneously or sequentially, or a combination thereof. Further, at least one recipient 60 may be connected to a device that empty the recipient 60 of the seawater after the valve 62 has been opened and the seawater entered the recipient. Thus, according to this embodiment, the recipient 60 may be reused multiple times.

According to another exemplary embodiment, the pressure difference between (i) the sea water pressure at 2000 to 4000 m in the closing chamber and (ii) the atmospheric pressure inside the recipient 60 generates an appropriate force for closing the ram preventer. However, if the seabed is deeper than 4000 m from the sea level, adapters (for example, pressure reducing valves) may be used to reduce the pressure difference such that the ram preventer is not damaged by the excessive pressure difference. On the contrary, if the sea bed lies at less than 2000 m from the sea surface, the pressure difference might not be enough to create enough force to close the ram preventer. Thus, according to an exemplary embodiment, accumulators may be used to supplement the hydrostatic pressure. However, even if no accumulators are used, the force may be generated as long as there is a pressure difference between the opening chamber and the low pressure storage recipient.

The disclosed exemplary embodiments provide a system and a method for generating a force undersea with a reduced consumption of energy and at a low cost. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other example are intended to be within the scope of the claims if they have structural elements that do not differ from the literal language of the claims, or if they include equivalent structural elements with insubstantial differences from the literal languages of the claims.

What is claimed is:

1. A water submerged device for generating a force under water, the device comprising:

a low pressure recipient configured to contain a volume of a first fluid at a low pressure;

an external enclosure containing a second fluid, the external enclosure having a chamber capable of containing water and having a pipe connecting the chamber to the water;

a first valve attached to the pipe having an open and a closed position, the first valve allowing fluid communication between the chamber and the water when in the open position, and sealing the chamber from the water when in the closed position;

an accumulator fluidly attached to the external enclosure and configured to provide a supplemental pressure to the enclosure;

an inlet connected to the low pressure recipient and configured to exchange the second fluid with the external enclosure; and a second valve connected to the external enclosure and the inlet and configured to separate a pressure source in the external enclosure from the low pressure recipient, wherein when the second valve is open, such that there is a flow communication between the external enclosure and the low pressure recipient, a pressure imbalance occurs in the external enclosure which generates the force and the second fluid from the external enclosure enters the low pressure recipient and compresses the first fluid.

2. The device of claim 1, further comprising:

a piston placed in the low pressure recipient and configured to slide inside the low pressure recipient to divide the first fluid from the external enclosure such that the second fluid from the external enclosure is separated from the first fluid.

3. The device of claim 1, further comprising:

a bladder placed in the low pressure recipient and configured as a barrier to divide the low pressure recipient from the external enclosure such that the second fluid from the external enclosure is separated from the first fluid.

4. The device of claim 1, further comprising:

a sealing metal element placed in the low pressure recipient and configured as a barrier to divide the low pressure recipient from the external enclosure such that the second fluid from the external enclosure is separated from the first fluid.

5. The device of claim 1, further comprising:

the external enclosure; and a ram preventer connected to a piston placed in the external enclosure and configured to receive the force and close rams to shear a pipe between the rams.

6. The device of claim 1, further comprising:

the external enclosure; and an annular blowout preventer connected to a piston placed in the external enclosure and configured to receive the force to seal a wellbore.

7. The device of claim 1, further comprising:

the external enclosure; and an accumulator connected to a closing chamber of the external enclosure and configured to provide a supplemental pressure to the closing chamber.

8. The device of claim 1, further comprising:

the external enclosure; and a control unit configured to activate the valve such that an opening chamber of the external enclosure communicates via a flow with the low pressure recipient.

9. The device of claim 1, wherein the enclosure is a cylinder and the first fluid is compressible.

10. A method for generating a force by moving a piston inside an external enclosure of a water submerged device, the piston dividing the external enclosure into a closing chamber and an opening chamber, the closing chamber capable of containing the water, and communicating with the water, an accumulator, or both, and the opening chamber communicating with a low pressure recipient via a pipe having a valve, the valve separating a pressure source in the opening chamber from the low pressure recipient, and the low pressure recipient containing a volume of a first fluid, the method comprising:

applying a first pressure to the closing and opening chambers, wherein the first pressure is generated by a weight of the water at a certain depth of the device, or by hydraulic fluid added to the closing chamber by the accumulator, or both;

applying a second pressure to the first fluid of the low pressure recipient, the second pressure being lower than the first pressure;

opening the valve between the opening chamber and the low pressure recipient such that a second fluid from the opening chamber moves into the low pressure recipient and compresses the first fluid, thereby generating the force by producing a pressure imbalance on the piston.

11. The method of claim 10, further comprising:

maintaining the first pressure inside the closing chamber substantially constant while the volume of the closing chamber is changing.

12. The method of claim 10, further comprising:

applying the force to a ram preventer such that rams are closed to shear a pipe between the rams.

13. The method of claim 10, further comprising:

applying the force to an annular blowout preventer such that a wellbore is sealed.

14. The method of claim 10, further comprising:

applying a supplemental pressure, from an accumulator, to the closing chamber.

15. The method of claim 10, wherein the first fluid is compressible.

16. The method of claim 10, wherein the enclosure is a cylinder.

17. The method of claim 10, wherein a piston is placed in the low pressure recipient and configured to slide inside the low pressure recipient to divide the first fluid from the external enclosure such that the second fluid from the external enclosure is separated from the first fluid.

18. The method of claim 10, wherein a bladder is placed in the low pressure recipient and configured as a barrier to divide the low pressure recipient from the external enclosure such that the second fluid from the external enclosure is separated from the first fluid.

19. The method of claim 10, wherein a sealing metal element placed in the low pressure recipient and configured as a barrier to divide the low pressure recipient from the external enclosure such that the second fluid from the external enclosure is separated from the first fluid.

20. A blowout preventer activation device comprising:

a low pressure recipient configured to contain a volume of a first fluid at a low pressure;

an external enclosure containing a second fluid, the external enclosure having a chamber capable of containing water, and having a pipe connecting the chamber to the water;

a first valve attached to the pipe having an open and a closed position, the first valve allowing fluid communication between the chamber and the water when in the open position, and sealing the chamber from the water when in the closed position;

an accumulator fluidly attached to the external enclosure and configured to provide a supplemental pressure to the enclosure;

an inlet connected to the low pressure recipient and configured to exchange the second fluid with the external enclosure;

a second valve connected to the external enclosure and the inlet and configured to separate a pressure source in the external enclosure from the low pressure recipient; and at least one of a ram preventer connected to a piston of the external enclosure and configured to receive the force and close rams to shear a pipe between the rams, or an annular blowout preventer connected to a piston of the external enclosure and configured to receive the force to seal a wellbore, wherein when the second valve is open, such that there is a flow communication between the external enclosure and the low pressure recipient, a pressure imbalance occurs in the external enclosure which generates the force and the second fluid from the external enclosure enters the low pressure recipient and compresses the first fluid.

* * * * *